United States Patent [19]

Estaque

[11] 4,136,330

[45] Jan. 23, 1979

[54] DEVICE FOR MONITORING THE FLOW AND TEMPERATURE OF A COOLANT

[75] Inventor: André F. Estaque, Bagneux, France

[73] Assignee: Societe Anonyme Automobiles Citroen, Paris, France

[21] Appl. No.: 737,708

[22] Filed: Nov. 1, 1976

[30] Foreign Application Priority Data

Nov. 28, 1975 [FR] France ..... 75 36585

[51] Int. Cl.[2] ..... G08B 19/00

[52] U.S. Cl. ..... 340/52 F; 340/57; 340/59; 340/521; 340/594; 340/610

[58] Field of Search ..... 340/52 F, 52 R, 57, 340/59, 236, 239 R; 200/52 R, 61.44

[56] References Cited

U.S. PATENT DOCUMENTS

| | | | |
|---|---|---|---|
| 1,653,685 | 12/1927 | Whittington | 340/57 X |
| 2,952,753 | 9/1960 | Kmiecik et al. | 200/81.9 |

*Primary Examiner*—Alvin H. Waring

*Attorney, Agent, or Firm*—Weingarten, Maxham & Schurgin

[57] ABSTRACT

In an automobile, a device for monitoring the flow and temperature of the coolant in the internal combustion engine, comprising a switch of a supply circuit for an alarm, whose mobile part is controlled by a single detector detecting both flow and temperature, disposed at one point of the cooling circuit.

11 Claims, 12 Drawing Figures

DEVICE FOR MONITORING THE FLOW AND TEMPERATURE OF A COOLANT

Figure 1B:
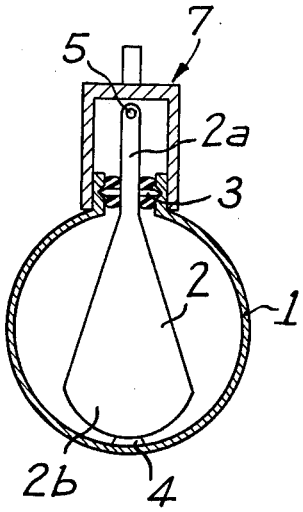

The present invention relates to a device for monitoring the flow and temperature of a coolant in an internal combustion engine.

It is often advantageous for the user of an automobile to have information at his disposal concerning the normal or abnormal state of the different members or elements ensuring the good running of his vehicle. Some of this information is indispensable, particularly concerning the temperature and circulation of the coolant in the engine of the vehicle.

Devices are known which indicate the temperature of the water circulating in the engine. These devices are generally constituted by metallic thermometers of the bimetallic strip type whose deformation causes the closure of a switch which leads to a warning light being lit.

The devices used for informing the driver on the flow are mechanical systems of the tongue type inserted in the cooling circuit which also closes a switch when the flow in this circuit is close to zero, and another warning light is lit. This information concerning lack of flow is advantageous as it makes it possible either to act quickly before the stoppage causes a detrimental rise in temperature, or to be aware that the excessive heating of the coolant is due to a defective circulation of the fluid.

To have this information available, it is therefore necessary to equip the cooling circuit of the vehicle with two separate devices, which has drawbacks, particularly in manufacture and in the fact that the information cannot be taken at the same point in the cooling circuit.

It is an object of the present invention to remedy these drawbacks and to propose a device which enables two independent alarm signals to be given, either when the temperature becomes excessive or when the flow is interrupted. If the two defects are simultaneous, the device according to the invention gives priority to one of the signals, notably the one indicating absence of flow.

To this end, the invention relates to a device for monitoring the flow and temperature of the coolant of an internal combustion engine, constituted by at least one switch of the electric supply circuit for at least one alarm system. According to the invention, the mobile part of said switch is controlled mechanically by a single flow and temperature detector disposed at a single point of the coolant circuit.

This detector is constituted by a tongue comprising an element which defects under the effect of an excessive temperature and which extends transversely in a pipe of the coolant circuit, said tongue being pivotable by one of its ends about a pin perpendicular to the direction of circulation of the fluid, fast with said pipe, said tongue further being adapted to abut by its other end on a stop provided in the pipe, under the effect of the circulation of the fluid, against the effect of an elastic return member coupled between said tongue and the pipe.

In a first embodiment of the invention, the said deformable element is constituted by the tongue itself which is in the form of a bimetallic strip.

In a second embodiment of the invention, the said deformable element is constituted by a bimetallic strip inside a hollow tongue and fitted in the end of the tongue opposite its pivoted end.

The mobile part of the switch is either constituted by a part of the said deformable element extending beyond said pivot or constituted by a lever fast with the deformable element and pivoted about the said pin extending outside the detector, the return member then being coupled between this lever and the pipe.

Figure 1A:
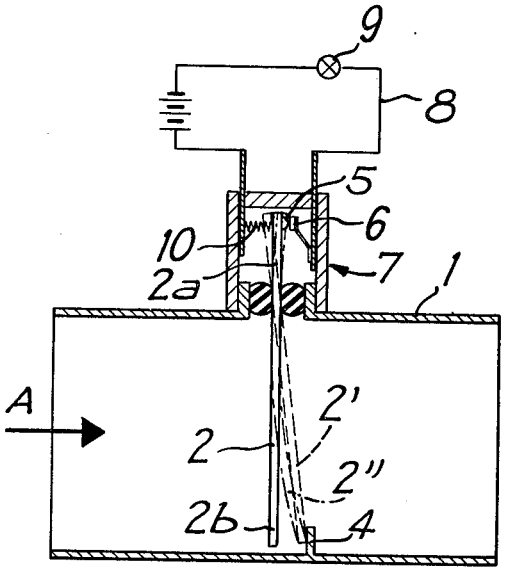

The invention will be more readily understood on reading the following example with reference to the accompanying drawings, in which:

FIGS. 1*a* and 1*b* are schematic views in cross section through a first embodiment of the invention.

Figure 2B:
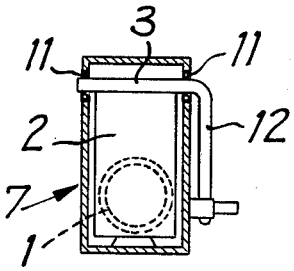
Figure 2A:
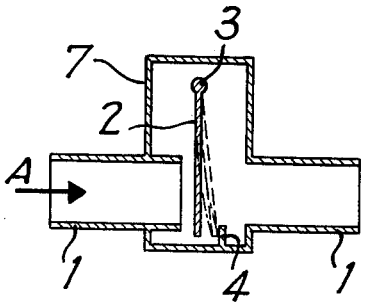
Figure 2C:
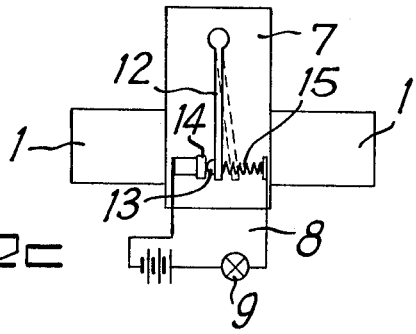

FIGS. 2*a*, 2*b*, 2*c* are views of a variant of this first embodiment.

Figure 3B:
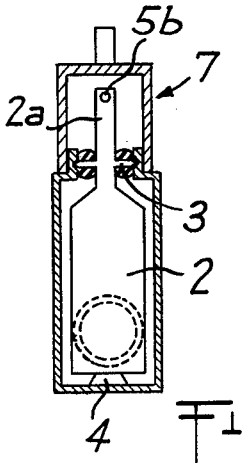
Figure 3A:
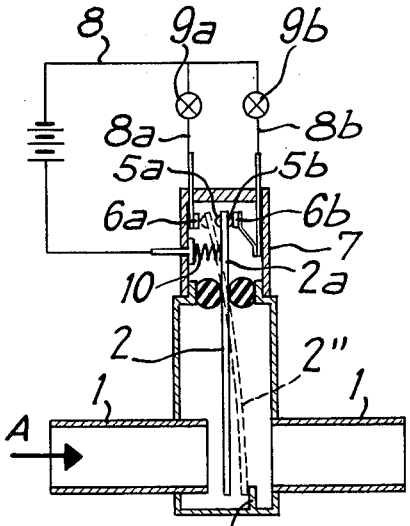

FIGS. 3*a*, and 3*b* are two schematic cross-sectional views of a second embodiment of the invention.

Figure 4A:
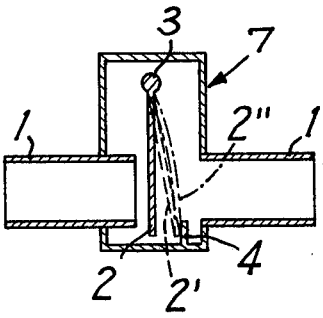
Figure 4B:
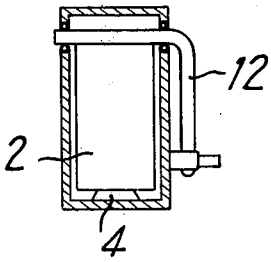
Figure 4C:
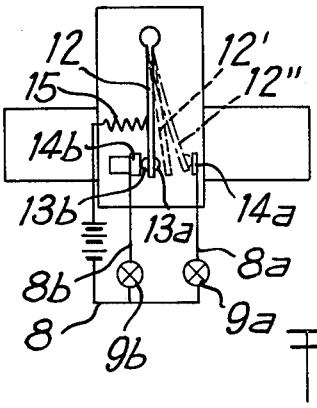

FIGS. 4*a*, 4*b*, 4*c* are views of a variant of this second embodiment.

Figure 5A:
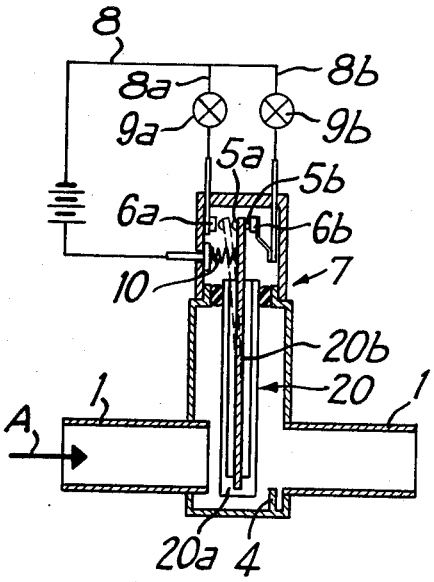
Figure 5B:
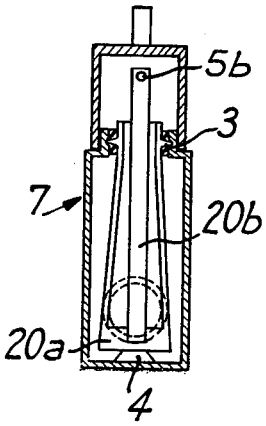

FIGS. 5*a* and 5*b* are views of a third embodiment of the invention.

Referring now to the drawings, FIGS. 1*a* and 1*b* show a portion 1 of a cooling circuit, in which the coolant may circulate in the direction of arrow A. A tongue 2 pivoted by one of its ends 2*a* about a pin 3 on a part of the pipe provided to this end, is so disposed that its largest surface faces the direction of the current A. The other end 2*b* of the tongue, opposite end 2*a*, may abut on a stop 4 provided inside the pipe. The end 2*a* of the tongue is provided with a contact stud 5 located opposite a contact element 6 fast with a casing 7 fixed on the pipe 1. The end 2*a* of the tongue constitutes the mobile part of the switch 5–6 of an electrical circuit circuit 8 for energising an alarm system 9, shown here in the form of a warning light. A return spring 10 coupled between the tongue 2 and the casing, constitutes an electrical connection between the circuit 8 and the tongue 2.

In FIG. 1*a*, the tongue 2 has been shown in solid lines, when no fluid is passing through the portion of pipe 1. It will be noted that, in this position, the switch 5–6 is closed, the spring 10 pressing the end 2*a* of the tongue against stud 6. When a fluid is circulating in pipe 1 in the direction of arrow A, the tongue is taken along by the fluid until it abuts against the stop 4, by rotating about axis 3. The tongue then takes the position 2′ shown in broken lines in FIG. 1*a*. In this position, the switch 5–6 is open.

In this embodiment, the tongue 2 is in fact a bimetallic strip that may take a certain curvature which increases as a function of the rise in the temperatures to which it is subjected. The coolant circulating in the direction of arrow A is normally at a stable temperature for which the tongue 2 has a small curvature, not allowing contact of said elements 5 and 6. On the other hand, if, for any reason, the temperature of the coolant rises, the curvature of the tongue 2 accentuates and part 2*a* thereof approaches the stud 6 until it comes into contact therewith. At that moment, the circuit 8 is closed. This position is shown at 2″ in FIG. 1*a*.

It is therefore seen that the device shown in FIGS. 1*a* and 1*b* closes the electrical circuit 8 in two circumstances: on the one hand, when there is no circulation of fluid and, on the other hand, when the fluid circulating is at too high a temperature. A monitoring device has therefore been constituted which is capable of alerting the user of the vehicle of a failure in the cooling circuit. It is to be noted that the rise in temperature of the coolant and the diminution of the flow generally go together and that the rise in temperature is a consequence of a diminution in flow. The device according to the invention therefore informs the user of an imminent increase in temperature of the coolant, as it will already have indicated an absence of flow.

FIGS. 2*a*, 2*b* and 2*c* illustrate a variant embodiment of the device shown in the preceding Figures. Certain of the elements described hereinabove are found therein with the same references. The pin 3 is here constituted by a cylindrical element mounted to rotate in the casing 7 via gaskets 11 and bent outside the casing, thus forming a lever 12 adapted to pivot about the axis 3, like tongue 2. The end of the lever 12 is provided with a contact bead 13, placed opposite a second contact element 14 fixed to the casing, so as to constitute a switch outside the casing 7 of the electrical circuit 8. Finally, it will be noted that the elastic return member is in the present case a spring 15 coupled between the lever 12 and the casing 7, which also constitutes an element for electrically connecting the bead 13 to the circuit 8.

In the absence of circulation of fluid, the switch 13, 14 is closed under the effect of the spring 15. The warning light 9 is thus lit up. The circulation of the fluid in the direction of arrow A causes the tongue 2 to pivot as far as the stop 4 and, via pin 3, causes the lever 12 to pivot at the same time. The switch 13, 14 is then open, the spring 15 being compressed. An excessive heating of the tongue 2 leads, as before, to a curvature resisting said pivoting. This results in a return of the lever 12 towards the contact element 14, the tongue 2 remaining in abutment, and a reclosure of the switch.

FIGS. 3*a* and 3*b* illustrate a monitoring device according to the invention similar to the one shown in FIGS. 1*a* and 1*b*, but provided with two alarm systems. Each side of the end 2*a* of the tongue 2 is provided with two contact beads 5*a* and 5*b* and the electrical circuit 8 has two branches 8*a* and 8*b* in parallel provided with a warning light 9*a*, 9*b* respectively and each terminating in a contact element 6*a*, 6*b*. In the absence of the circulation of fluid, the spring 10 maintains the bead 5*b* against element 6*b*. The switch 5*b*, 6*b* is closed and the warning light 9*b* is lit up, indicating absence of circulation. Switch 5*a*, 6*a* is open.

When a circulation of fluid is established in the direction of arrow A, the tongue 2 is maintained in abutment against stop 4 against the effect of the spring 10. The spacing of the contacts 6*a*, 6*b* is such that, in this position, the tongue 2 is not in contact with either element 6*a* or with element 6*b*.

Finally, the fluid circulating in the direction of arrow A reaches an excessive temperature, causing the bimetallic tongue 2 to deflect. It will be noted, in this case, that the arrangement of the tongue is such that it leads to an increase in the angle of pivot taken under the effect of the flow, contrary to the case of FIGS. 1*a* and 1*b*, in which the rotation due to the heating resisted the rotation due to the flow. This supplementary rotation leads to the closure of the switch 5*a*, 6*a* and to the lighting of the warning light 9*a* indicating an excess of temperature. This state of the device appears at 2" in FIG. 3*a*.

It is to be noted that, due to the spring 10, when the excess temperature and interruption of the flow of fluid occur simultaneously, it is the switch 5*b*, 6*b* which will close. The indication of absence of flow therefore has priority.

FIGS. 4*a*, 4*b* and 4*c* show a variant embodiment of the device according to FIGS. 3*a* and 3*b*, repeating the same arrangements of FIGS. 2*a* to 2*c*, enabling the electrical contacts to be placed outside the casing 7 and the pipe 1, in order to isolate them from the moist atmosphere prevailing inside these two elements.

The circuit 8 is divided into two parallel branches 8*a*, 8*b* terminating at a contact element 14*a*, 14*b* respectively.

The lever 12 has two opposite contact beads 13*a* and 13*b* which cooperate with elements 14*a* and 14*b* respectively. Finally, the positions 12, 12' and 12" of the lever 12 correspond to the positions 2, 2' and 2" taken by the tongue 2 in the different possible states of functioning of the device. The results obtained are identical to those of FIGS. 3*a*, 3*b*, namely the selective lighting or the non-lighting of the warning lights 9*a* and 9*b* depending on the dynamic and thermal state of the coolant.

Finally, FIGS. 5*a* and 5*b* illustrate a third embodiment of the device according to the invention. This embodiment is of the same type as that of FIGS. 3*a*, 3*b* and comprises certain of the elements, with the same references, described with regard thereto. The tongue 20 is constituted by a first hollow element 20*a*, inert from the thermal point of view, i.e. not capable of bending under the effect of heat. This element 20*a* is pivoted on casing 7, like tongue 2 of the preceding Figures, about an axis 3 via a gasket (not referenced), and may abut on the stop 4. Inside this element is fitted one end of a bimetallic element 20*b* capable of bending under the effect of heat. Each side of the free end of this element 20*b* bears contact beads 5*a* and 5*b* that may cooperate with elements 6*a* and 6*b*. The return spring 10 is coupled between the casing and said element 20*b*.

When there is no circulation of fluid, the spring 10 causes the assembly 20 to pivot about axis 3 and closes the switch 5*b*, 6*b*. The warning light 9*b* (indicating absence of flow) lights up. When the fluid circulates in the direction of A, the assembly 20 pivots against the spring 10 and abuts on stop 4. The spacing of the contact elements 6*a* and 6*b* is sufficient for both the switches 5*a*, 6*a* and 5*b*, 6*b* to be open, in this position of the element 20. Finally, further to a sufficient heating, the bimetallic strip 20*b* takes such a curvature as to lead to the closure of the switch 5*a*, 6*a* and the warning light 9*a* (indicating excess temperature) lights up. Due to spring 10, priority is given to the absence of flow, in the case of two failures simultaneously.

The monitoring device according to the invention gives independent information on the state of the coolant of the engine of a motor vehicle. Due to its uniqueness, it may readily be placed at the most favourable point in the cooling circuit.

The invention finds advantageous application in the field of automobile construction.

What is claimed is:

1. In an automobile, a device for monitoring the flow and temperature of the coolant in the internal combustion engine, constituted by at least one switch of the electrical supply circuit for an alarm system, wherein the mobile part of said switch is controlled mechanically by a single flow and temperature detector disposed at a single point in the coolant circuit, said detector being constituted by a tongue comprising an element which deflects under the effect of the temperature and which extends transversely in a pipe of the coolant circuit, said tongue being pivoted by one of its ends about a pin disposed perpendicular to the direction of circulation of fluid and operatively supported on said pipe, a stop provided in the pipe, and an elastic return member coupling the tongue with the pipe, said tongue being adapted to abut by its other end on said stop under the effect of the circulation of the fluid and against the effect of the elastic return member.

2. A device as defined in claim 1, wherein the mobile part is constituted by a part of the deformable element extending beyond the pivot pin.

3. A device as defined in claim 1, wherein the deformable element is constituted by the tongue itself in the form of a bimetallic strip.

4. A device as defined in claim 3, wherein the bimetallic strip is disposed so as to bend under the effect of the temperature of the coolant, the curvature leading to the pivoting of its part adjacent the said pin against the pivoting provoked by the circulation of the fluid.

5. A device as defined in claim 3, wherein the bimetallic strip is disposed so as to bend under the effect of the temperature of the coolant, the curvature leading to a pivoting of its part adjacent the said pin in the same direction as that provoked by the circulation of the fluid.

6. A device as defined in claim 5, comprises two electrical circuits in parallel for supplying two alarm systems, one corresponding to the indication of temperature, the other to flow, each being equipped with a switch whose mobile part is common.

7. A device as defined in claim 3, wherein the mobile part is constituted by a lever fast with the bimetallic strip pivoted about the pin and extending outside the detector and wherein the elastic return member is coupled between this lever and the pipe.

8. A device as defined in claim 2, wherein the tongue is hollow and the deformable element is constituted by a bimetallic strip inside said tongue and fitted in the end of the tongue opposite its pivoted end.

9. A device as defined in claim 8, wherein the bimetallic strip is disposed so as to bend under the effect of the temperature of the coolant, the curvature leading to the pivoting of its part adjacent the pin against the pivoting provoked by the circulation of the fluid.

10. A device as defined in claim 8, wherein the bimetallic strip is disposed so as to bend under the effect of the temperature of the coolant, the curvature leading to the pivoting of its part adjacent the pin in the same direction as the pivoting provoked by the circulation of the fluid.

11. A device as defined in claim 10, comprising two electrical circuits in parallel for supplying two alarm systems, one corresponding to the indication of temperature, the other to the indication of flow, each being equipped with a switch whose mobile part is common.

* * * * *